US012635742B1

(12) United States Patent
Arbib

(10) Patent No.: US 12,635,742 B1
(45) Date of Patent: May 26, 2026

(54) HIGH-PERFORMANCE SHORTS FOR WATER BASED SPORTS

(71) Applicant: Ofek Arbib, Encinitas, CA (US)

(72) Inventor: Ofek Arbib, Encinitas, CA (US)

( * ) Notice: Subject to any disclaimer, the term of this patent is extended or adjusted under 35 U.S.C. 154(b) by 0 days.

(21) Appl. No.: 19/259,226

(22) Filed: Jul. 3, 2025

(51) Int. Cl.
*A41D 1/00* (2018.01)
*A41D 1/089* (2018.01)
*A41D 31/18* (2019.01)

(52) U.S. Cl.
CPC ..... *A41D 1/089* (2018.01); *A41D 31/18* (2019.02)

(58) Field of Classification Search
CPC ..... A41D 1/089; A41D 31/18; A41D 7/00; A41D 7/005; A41D 7/001
See application file for complete search history.

(56) References Cited

U.S. PATENT DOCUMENTS 1,747,562 A * 2/1930 Wellstatter ..... A41B 9/08 2/212
1,966,060 A * 7/1934 Cohen ..... A41B 9/04 2/407
2,033,065 A * 3/1936 Galligan ..... A41D 7/00 264/DIG. 72
2,145,688 A * 1/1939 Flamberg ..... A41B 9/02 2/401
2,250,218 A * 7/1941 Cadous ..... A41B 9/04 2/401
2,459,043 A * 1/1949 Owenby ..... A41B 9/02 2/401
2,494,261 A * 1/1950 Owenby ..... A41B 9/02 2/404
2,983,924 A * 5/1961 Cohen ..... A41D 7/005 2/404
3,083,710 A * 4/1963 Rauser ..... A41B 9/02 2/404
3,110,903 A * 11/1963 Burchard ..... A41D 1/14 2/221
3,470,878 A * 10/1969 Gottlieb ..... A41B 11/12 450/95
3,478,748 A * 11/1969 Bjorn-Larsen ..... A41F 11/18 450/106
3,496,944 A * 2/1970 Cuozzi ..... A41B 11/126 2/407
3,945,051 A * 3/1976 Burkard ..... A41D 1/089 2/400
4,223,408 A * 9/1980 Sullivan ..... A41D 1/08 2/238
4,602,388 A * 7/1986 Underwood ..... A41D 1/089 2/238
D313,692 S * 1/1991 Karn ..... D2/738
5,136,727 A * 8/1992 Brisco ..... A41D 1/08 2/70
5,575,006 A * 11/1996 Wolfe ..... A41D 13/1254 2/221
5,649,328 A * 7/1997 Martin ..... A41D 13/0537 2/238

(Continued)

*Primary Examiner* — Richale L Quinn
(74) *Attorney, Agent, or Firm* — IdeaParlor Law; Anthony Whittington

(57) ABSTRACT

A pair of board shorts is provided. The pair of board shorts includes an exterior shell having a multi-panel construction formed from a hydrophobic, quick-dry, stretchable fabric; an interior compression liner integrally attached to the waistband of the exterior shell, the liner composed of a moisture-wicking, four-way stretch fabric.

20 Claims, 8 Drawing Sheets

(56) References Cited

U.S. PATENT DOCUMENTS 5,704,071 A * 1/1998 Barclay ..... A41D 1/089 2/400
D403,487 S * 1/1999 Crupi ..... D2/731
5,870,777 A * 2/1999 Hans ..... A41D 1/089 2/249
5,978,971 A * 11/1999 Wald ..... A41B 9/02 2/403
6,199,215 B1 * 3/2001 Biggerstaff ..... A41D 1/08 2/405
6,665,882 B1 * 12/2003 Pedrick ..... A41D 7/005 2/228
7,231,671 B2 * 6/2007 Allen ..... A41D 1/06 2/232
7,849,518 B2 * 12/2010 Moore ..... A41D 1/089 2/238
7,937,770 B1 * 5/2011 Hernandez ..... A41D 7/005 441/120
7,941,871 B1 * 5/2011 Jorgensen ..... A41D 7/005 2/238
9,585,423 B2 * 3/2017 Abasova ..... A41B 11/128
10,219,553 B2 * 3/2019 Curran ..... A41D 1/084
10,645,985 B2 * 5/2020 Lomax ..... A41F 9/025
11,253,019 B2 * 2/2022 Moore ..... A41F 9/02
11,540,572 B2 * 1/2023 Horbatuck ..... A41D 7/00
D986,531 S * 5/2023 Baker, II ..... D2/704
11,793,243 B2 * 10/2023 Xu ..... A41C 5/00
11,832,665 B2 * 12/2023 Aihara ..... A41D 27/285
11,871,804 B2 * 1/2024 Grimm ..... A41D 27/20
11,969,031 B2 * 4/2024 Luong ..... A41D 1/08
D1,046,380 S * 10/2024 Vysotska ..... D2/738
12,156,549 B2 * 12/2024 McNally ..... A41F 9/02
D1,083,301 S * 7/2025 Jiang ..... D2/742
2003/0135907 A1 * 7/2003 Sanchez ..... A41D 7/005 2/67
2003/0208829 A1 * 11/2003 Ragot ..... A41D 7/005 2/67
2005/0273907 A1 * 12/2005 Fontes ..... A41D 1/06 2/235
2005/0283883 A1 * 12/2005 Fontes ..... A41D 1/06 2/238
2007/0235125 A1 * 10/2007 Doeling ..... A41D 27/08 2/243.1
2008/0139086 A1 * 6/2008 Jones ..... A41C 1/003 450/94
2010/0081984 A1 * 4/2010 Coffinardi ..... A41B 11/126 2/167
2010/0300453 A1 * 12/2010 Wells ..... A61F 6/02 128/844
2011/0078839 A1 * 4/2011 Leonard ..... A41D 27/02 2/67
2011/0283442 A1 * 11/2011 Jorgenson ..... A41D 7/005 2/227
2012/0011638 A1 * 1/2012 Geary ..... A41F 9/025 2/336
2012/0036615 A1 * 2/2012 Bradstreet ..... A41D 1/08 2/236
2012/0117714 A1 * 5/2012 Peck ..... A41D 31/185 2/228
2012/0124712 A1 * 5/2012 Vanlandingham ..... B65D 75/5883 2/400
2012/0246791 A1 * 10/2012 Weisman ..... A41F 9/00 2/67
2012/0260400 A1 * 10/2012 Franz ..... A41D 27/04 2/236
2013/0007947 A1 * 1/2013 Moore ..... A41D 31/185 2/236
2016/0095367 A1 * 4/2016 Curran ..... A41D 27/285 2/243.1
2016/0213071 A1 * 7/2016 Vornle von Haagenfels ..... A41D 1/08
2017/0172225 A1 * 6/2017 Romero ..... A41D 31/0005
2017/0258159 A1 * 9/2017 Moore ..... A41F 9/02
2019/0029344 A1 * 1/2019 Moore ..... A41D 7/005
2019/0373970 A1 * 12/2019 Bolker ..... A41B 9/001
2020/0146377 A1 * 5/2020 McCarty ..... A63B 57/00
2020/0214377 A1 * 7/2020 Horbatuck ..... A41D 7/00
2020/0229516 A1 * 7/2020 Curran ..... A41D 1/06
2020/0297040 A1 * 9/2020 Weber-Unger ..... A41B 9/02
2020/0375274 A1 * 12/2020 McNally ..... A41D 1/089
2021/0274869 A1 * 9/2021 McNally ..... A41B 9/02
2023/0292864 A1 * 9/2023 Horbatuck ..... A41D 27/22 2/69
2023/0320443 A1 * 10/2023 Roth ..... A41D 27/207 2/253
2025/0010597 A1 * 1/2025 Hu ..... B32B 5/022
2025/0024900 A1 * 1/2025 Milian ..... A41D 7/001
2025/0311799 A1 * 10/2025 Shaw ..... A41D 7/005

* cited by examiner

Pocket Venting and Drainage Detail

HIGH-PERFORMANCE SHORTS FOR WATER BASED SPORTS

CROSS-REFERENCES TO RELATED APPLICATIONS

N/A.

FIELD OF THE TECHNOLOGY

The present disclosure generally relates to athletic apparel and, more specifically, to hybrid board short combining the hydrodynamic utility of surf wear with the structural mobility and closure features of mixed martial arts (MMA) shorts. Ideal for water-based sports requiring freedom of movement, secure fit, and rapid drying.

DESCRIPTION OF THE RELATED ART

Traditional board shorts offer limited stretch, rely on basic Velcro or drawstring closures, and can hinder mobility. Conversely, MMA shorts are designed for aggressive movement and durability but lack water-compatible materials and hydrodynamic form factors. Current hybrid or athletic shorts often sacrifice full feature sets from both categories.

There exists a need for a high-performance garment that addresses these shortcomings by combining the technical utility of MMA shorts with the hydrodynamic design and materials of board shorts.

SUMMARY

In an embodiment, a pair of hybrid athletic shorts is provided. The pair of hybrid athletic shorts includes an exterior shell having a multi-panel construction formed from a hydrophobic, quick-dry, stretchable fabric; an interior compression liner integrally attached to the waistband of the exterior shell, the liner composed of a moisture-wicking, four-way stretch fabric; a diamond-shaped gusset panel disposed in a crotch region of the exterior shell, the gusset comprising a stretchable material to facilitate leg separation and mobility; a side slit disposed on each leg of the exterior shell, extending upward from a bottom hem to enhance range of motion; a waistband assembly comprising a drawstring, an internal closure mechanism, and a hook-and-loop fastener for securing the waistband to the wearer's body; one or more drainage pockets having mesh linings and fluid-ejection apertures for reducing water retention during aquatic use; and at least one laser-perforated vent or logo opening disposed on a side panel of the exterior shell to facilitate drainage and ventilation.

In another embodiment, athletic apparel is provided. The athletic apparel includes an exterior shell having a multi-panel construction formed from a hydrophobic, quick-dry, stretchable fabric; an interior compression liner integrally attached to the waistband of the exterior shell, the liner composed of a moisture-wicking, four-way stretch fabric; a diamond-shaped gusset panel disposed in a crotch region of the exterior shell, the gusset comprising a stretchable material to facilitate leg separation and mobility; a side slit disposed on each leg of the exterior shell, extending upward from a bottom hem to enhance range of motion; a waistband assembly comprising a drawstring, an internal closure mechanism, and a hook-and-loop fastener for securing the waistband to the wearer's body; one or more drainage pockets having mesh linings and fluid-ejection apertures for reducing water retention during aquatic use; and at least one laser-perforated vent or logo opening disposed on a side panel of the exterior shell to facilitate drainage and ventilation.

In still another embodiment, a pair of board shorts is provided. The pair of board shorts includes an exterior shell having a multi-panel construction formed from a hydrophobic, quick-dry, stretchable fabric; an interior compression liner integrally attached to the waistband of the exterior shell, the liner composed of a moisture-wicking, four-way stretch fabric; a diamond-shaped gusset panel disposed in a crotch region of the exterior shell, the gusset comprising a stretchable material to facilitate leg separation and mobility; a side slit disposed on each leg of the exterior shell, extending upward from a bottom hem to enhance range of motion; a waistband assembly comprising a drawstring, an internal closure mechanism, and a hook-and-loop fastener for securing the waistband to the wearer's body; one or more drainage pockets having mesh linings and fluid-ejection apertures for reducing water retention during aquatic use; and at least one laser-perforated vent or logo opening disposed on a side panel of the exterior shell to facilitate drainage and ventilation.

BRIEF DESCRIPTION OF THE DRAWINGS

The present invention is described in detail below with reference to the attached drawing figures, which are incorporated by reference herein and wherein.

DETAILED DESCRIPTIONS

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent application, which would still fall within the scope of the claims.

Figure 1:
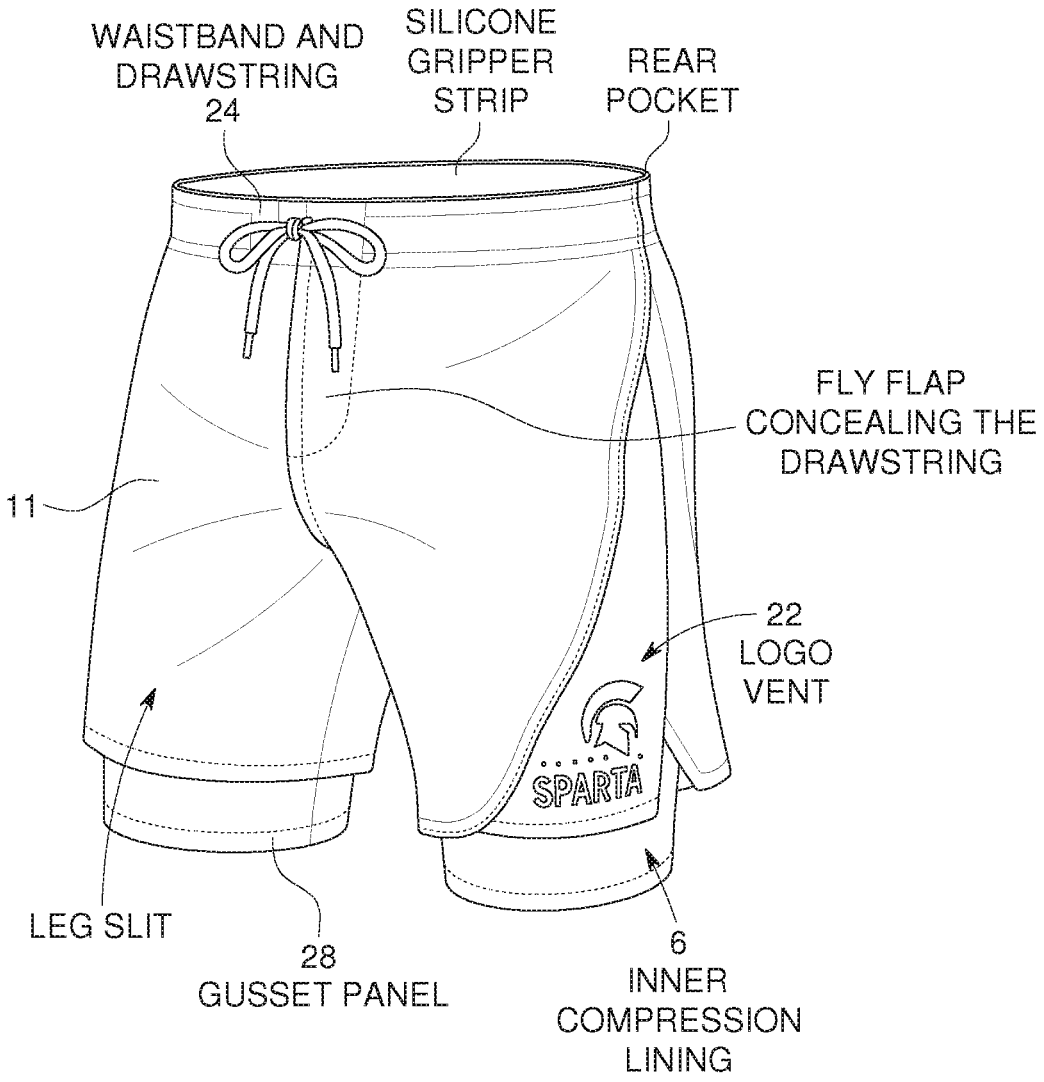
FIG. 1 is a system diagram of hybrid athletic shorts illustrating an exemplary embodiment of the invention.

As shown in FIG. 1, the hybrid athletic shorts comprise an exterior shell 15 and 20, inner compression lining 6 extending below the outer hem, waistband and drawstring 26, leg slit 11, gusset panel 28, logo vent 22, and rear pocket (not shown)

Figure 2:
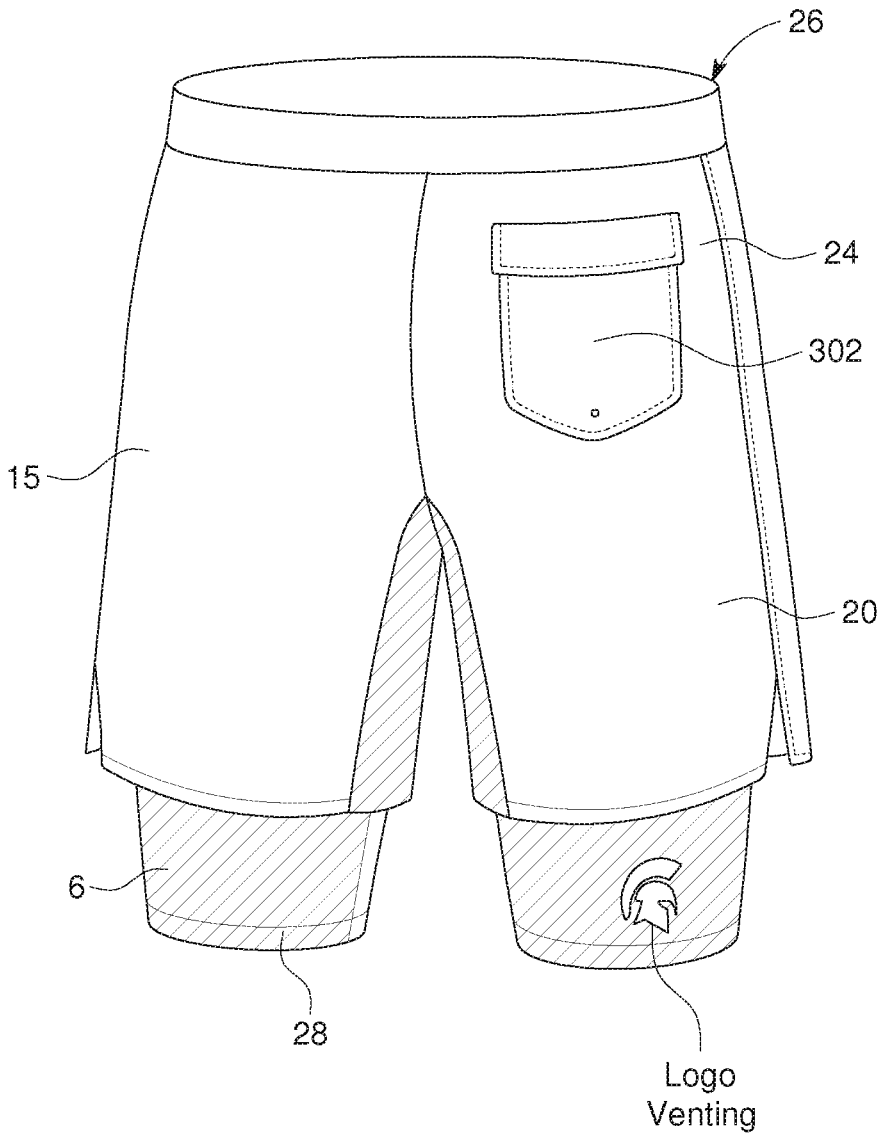
FIG. 2 is a system diagram of the shorts in accordance with another exemplary embodiment of the invention.

As shown in FIG. 2, the shorts comprise exterior shell panels 15 and 20, waistband structure 26, integrated gusset 28, logo 30, and rear pocket 302 with a flap 24, along with side slits and a portion of the visible interior compression lining 6.

Figure 3:
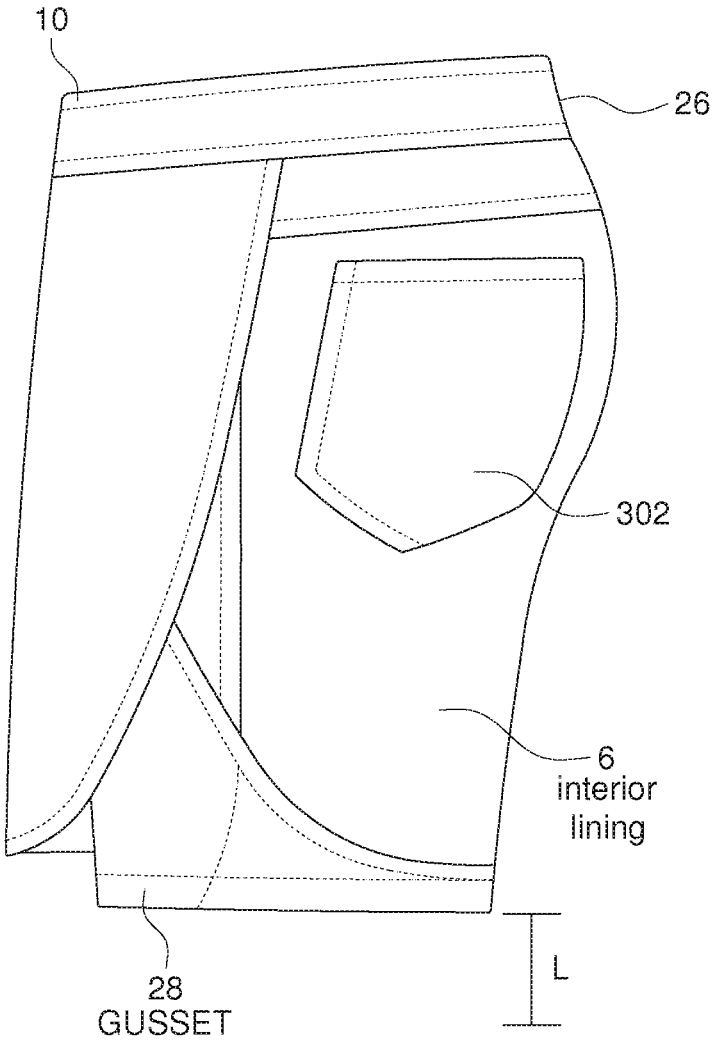
FIG. 3 is a system diagram of the shorts in accordance with another exemplary embodiment of the invention.

As shown in FIG. 3, the shorts 10 comprise a lateral slit (not shown) in the exterior shell 15 and 20, gusset 28 placement at the crotch area, waistband stitching 26, and the way the compression liner 6 fits beneath the shell.

Figure 4:
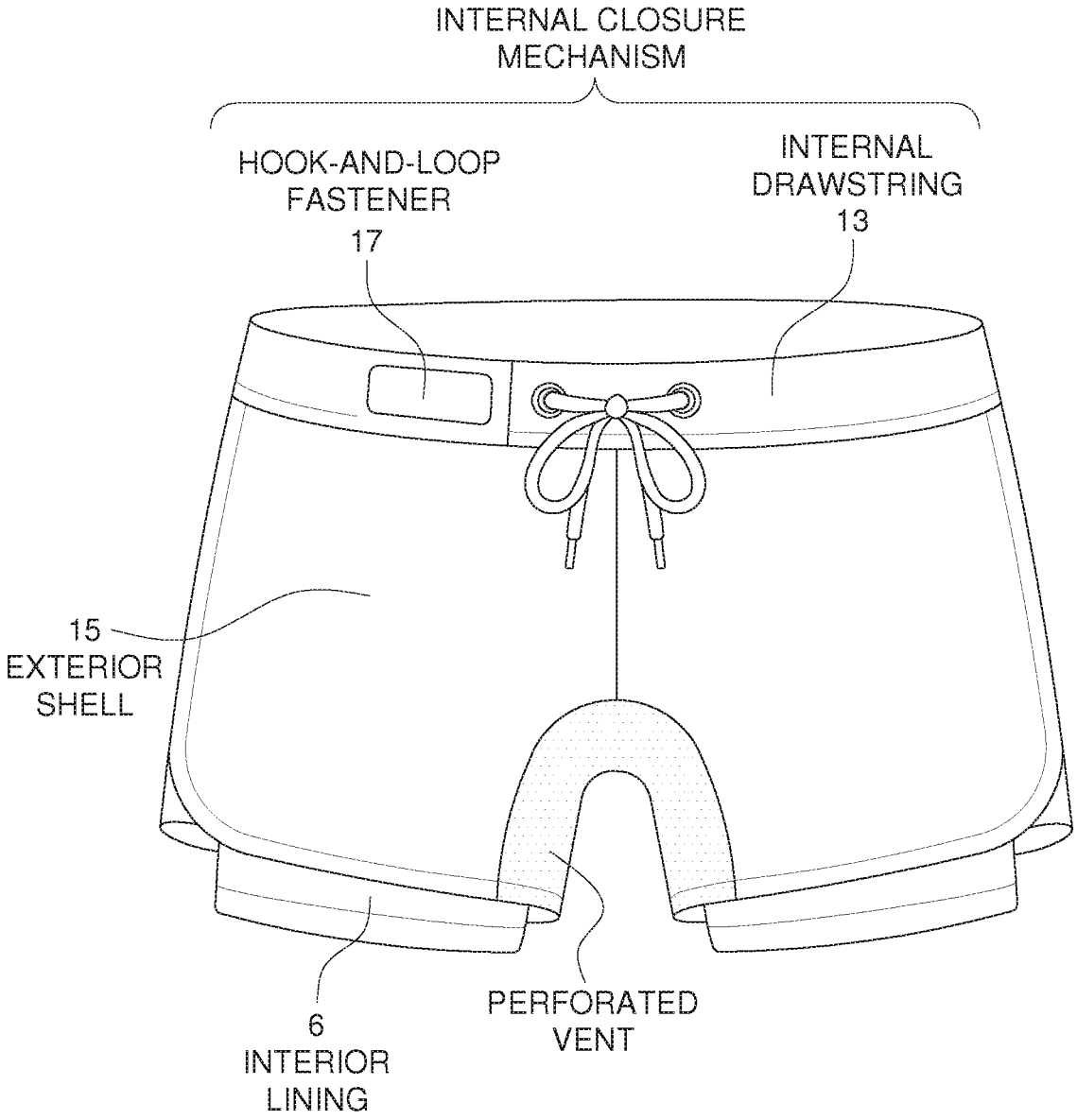
FIG. 4 is a system diagram of the waistband interior in accordance with another exemplary embodiment of the invention.

As shown in FIG. 4, the waistband interior includes the combination closure system having the hook-and-loop fastener 17, exterior shell 15, internal drawstring 13 routed through eyelets, and the contoured front panel assembly 15 and 20 with an open fly flap and exterior lining 7.

Figure 5:
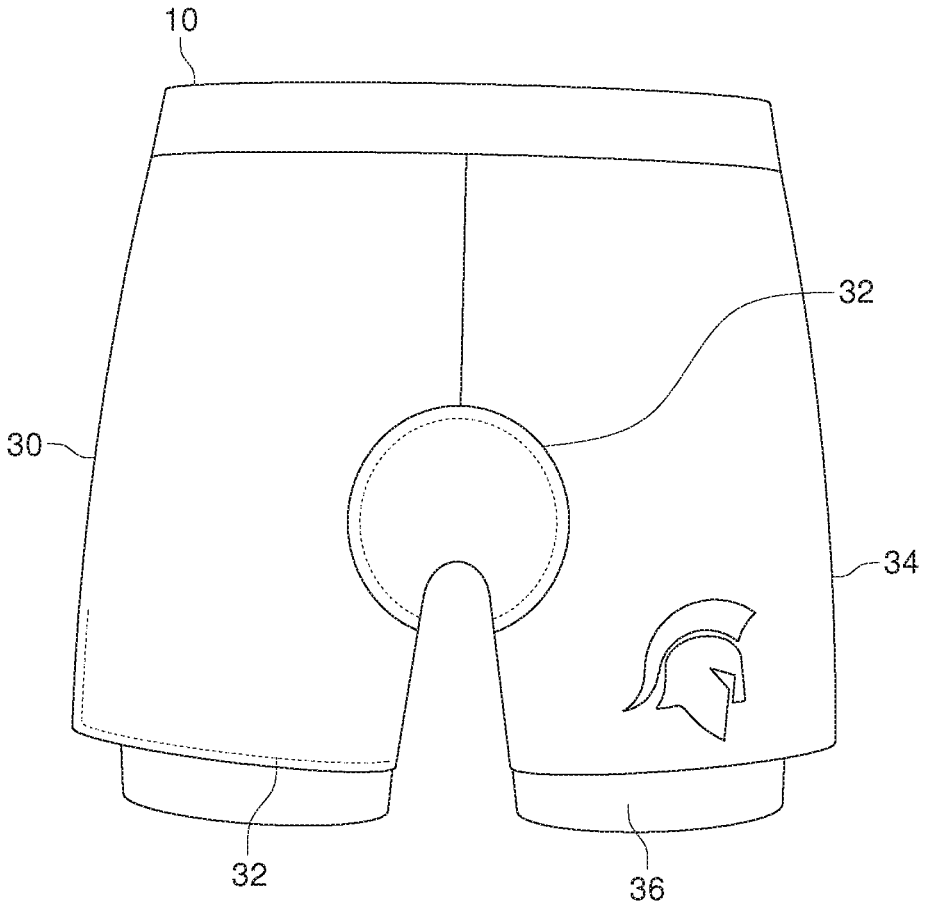
FIG. 5 is a system diagram of the gusset and compression liner assembly in accordance with another exemplary embodiment of the invention.

As shown in FIG. 5, the shorts 10 have a gusset 28 and a compression liner assembly 36, illustrating the gusset panel geometry 32, the relative panel placement of the outer shell 34 and 30, and the Spartan-logo placement on the liner.

Figure 6:
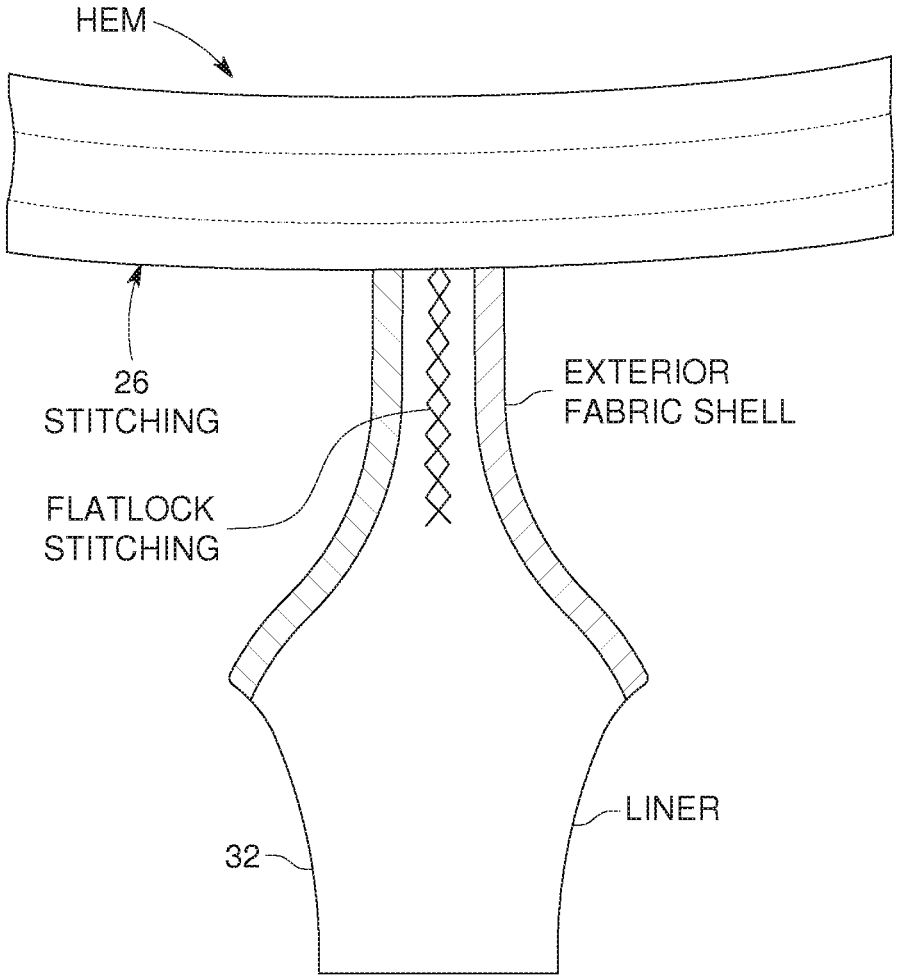
FIG. 6 is a system diagram of the hem and liner in accordance with another exemplary embodiment of the invention.

As shown in FIG. 6, the shorts 10 have a hem and liner 32, showing the interface between the exterior shell, interior compression lining, and flatlock stitching 26 that joins the materials while preventing chafing.

Figure 7:
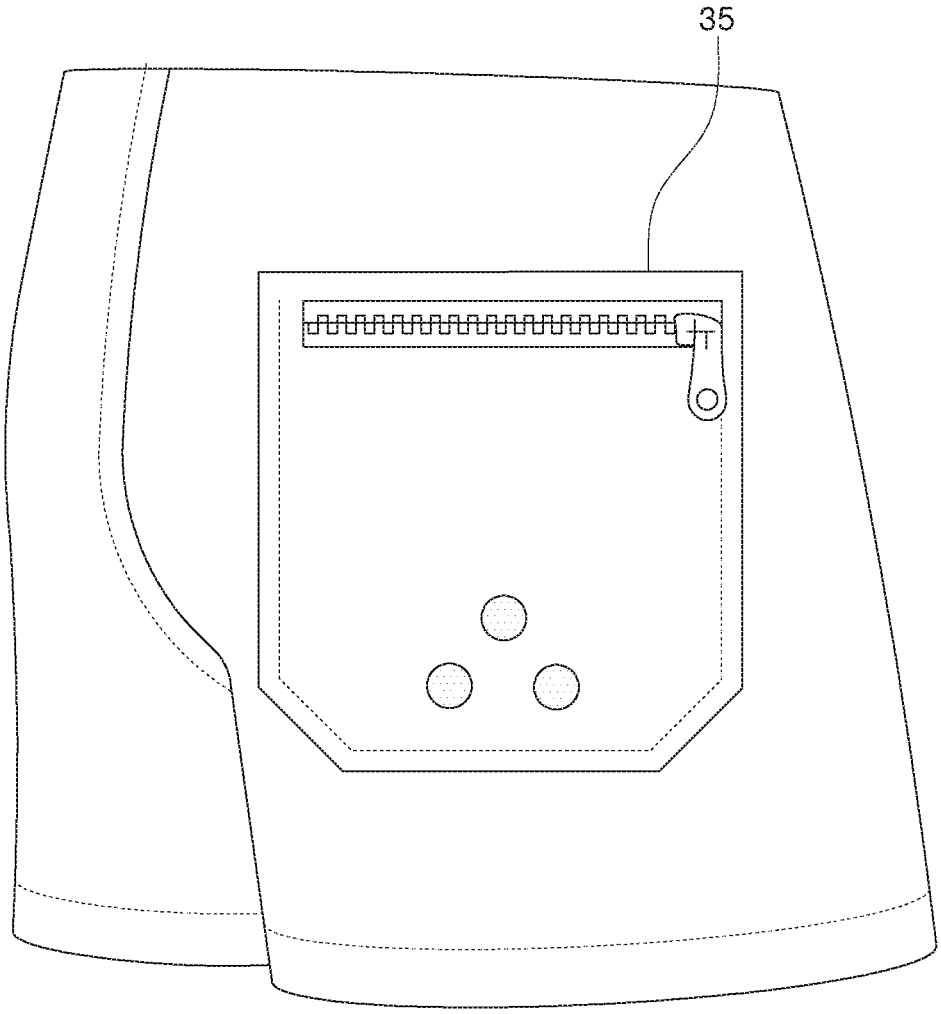
FIG. 7 is a system diagram of the pocket venting and drainage system in accordance with another exemplary embodiment of the invention.

As shown in FIG. 7, the shorts 10 have pocket venting and drainage system, including a zippered or flap-style closure 35 and a series of drainage apertures or grommets located at the bottom of the pocket.

Figure 8:
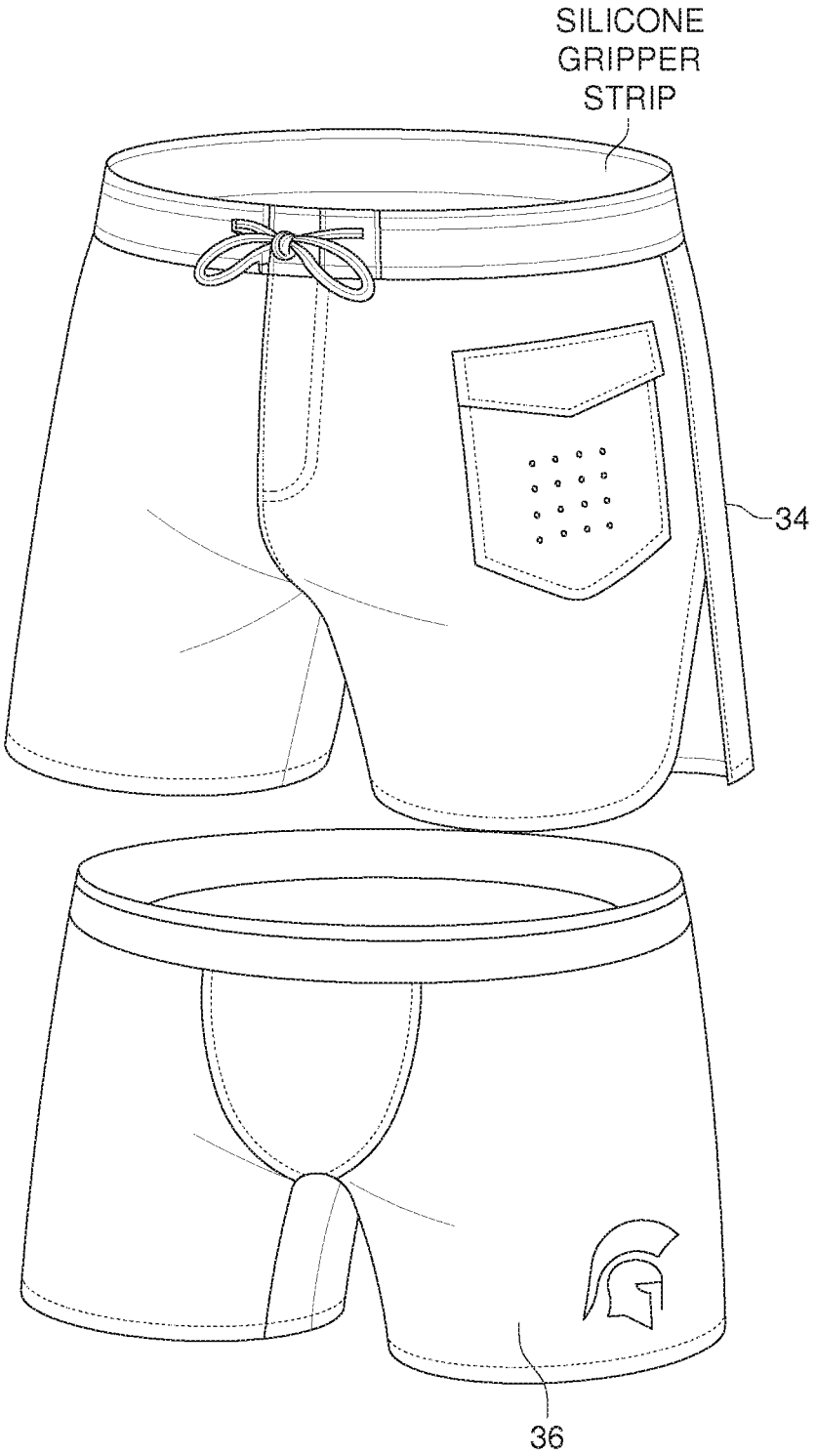
FIG. 8 is a system diagram showing the construction layering of the garment in accordance with another exemplary embodiment of the invention.

As shown in FIG. 8, the construction layering of the shorts 10 are shown separating the outer short shell 34 and inner compression liner 36 to illustrate the modular build, waistband integration, and how the two components align in assembled form.

In an embodiment, the present invention may include novel board shorts integrating performance features from MMA shorts into water-optimized construction. It includes multi-panel designs, stretch gussets, leg slits, and advanced closure systems typically reserved for combat sports, while being constructed from hydrophobic, quick-dry, and lightweight materials ideal for water environments.

In another embodiment, the present invention may include a novel hybrid short that enables superior freedom of movement, secure fit, and rapid water drainage. The present invention may include:

Anatomically contoured multi-panel construction.

Hydrophobic and UV-resistant materials with four-way stretch.

MMA-style waistband and closure system.

Internal compression liner with chafe-resistant support.

Advanced seam engineering and water egress venting.

In still another embodiment, the present invention may include a multi-panel assembly, stretch gusset insert, side leg slits.

Multi-Panel Assembly

In some embodiments, a multi-panel assembly may include shorts that are composed of anatomically shaped panels tailored to conform to the body's movement, mimicking the segmented layout of MMA shorts. Further, multi-panel assembly may include key panels include: two front leg panels; two rear leg panels; inner thigh stretch gusset; waistband support panel.

In other embodiments, a multi-panel assembly may include front leg panels having two symmetrical front panels shaped to follow the curvature of the quads, each approximately 17" long×8.5" wide at the hem; rear leg panels having tapered panels flaring toward the glutes for ergonomic fit; inner thigh gusset having diamond-shaped stretch panel measuring approximately 7.5" long (point-to-point) and 4.5" at the widest, stitched into the crotch for unrestricted motion; and waistband panel having a 2.5" tall belt band that runs around the waist with internal elastic and drawstring channel.

Compression Liner/Interior Shell

In an embodiment, the compression liner/interior shell may include integrated boxer-brief liner made of 85% polyester/15% spandex; the shell/liner may extend 1.5-2" below outer hem for visible compression effect; and a seamless hem at the leg opening with silicone grip strip to prevent ride-up.

Shell Fabric

In still another embodiment, the shell fabric may include an exterior shell 90% polyester, 10% spandex blend; fabric weight: 170-180 GSM (grams per square meter); Durable water-repellent (DWR) coating; and a abrasion and saltwater/chlorine resistant layer.

Stretch Gusset Insert

In another embodiment, a stretch gusset insert may include diamond or trapezoidal gusset located at the inner thigh/crotch region, made of four-way stretch hydrophobic spandex or elastane blend, improves leg separation range and dynamic mobility for surfing, wakeboarding, and paddling.

Gusset and Liner

In yet another embodiment, the gusset and liner may include recycled polyester-spandex knit with 4-way stretch; moisture-wicking and anti-odor properties; and color contrast for branding purposes (e.g., black outer with purple inner).

Stitching and Seams

In another embodiment, the stitching and seams may include flatlock stitching for all contact seams. Alternatively, the stitching and seams may include bonded or overlock seams at waist and hem.

Side Leg Slits

In still another embodiment, a slide leg slits may include side vents/slits extend vertically along the lower hem, replicating MMA design, to prevent fabric binding during squats or extended kicks. These may be reinforced with double-stitching or bonded tape seams to maintain structural integrity in wet conditions.

In alternate embodiment, the slide leg slits may include side vents extend 4-5" upward from the hem to allow lateral leg expansion and may be reinforced using bonded seam tape or double-needle topstitching.

Hydrophobic Fabric Blend

In yet another embodiment, the hydrophobic fabric blend may include body panels are composed of a lightweight, fast-drying polyester-spandex blend with durable water-repellent (DWR) coating. Stretch areas (gusset and waistband) may utilize quick-dry Lycra or recycled stretch knit. All fabrics may be UV-resistant and salt/chlorine-resistant for long-term aquatic performance.

Hybrid Waist Closure System

In an embodiment, a hybrid secure closure may combine a hook-and-loop fly cover, internal drawstring, and a top-grip Velcro or clasp buckle typically used in MMA fight shorts. In some embodiments, this closure may ensure a locked-in fit during dynamic movement and wave impact. Alternatively, optional elastic back waistband or gripper tape lining may be used for anti-slip security.

In other embodiments, hybrid waist closure system may include triple-action system that comprises: a hook-and-loop front fly flap (1.5" wide); internal drawstring made of silicon-tipped nylon cord; and a top-lock Velcro tab (1"×1") or cam buckle clasp closure.

Anti-Slip

In some embodiments, anti-slip function may be employed with an interior waistband lined with silicone gripper tape or elasticized rear panel for extra hold in turbulent water.

Hidden Drainage Pockets

In another embodiment, hidden drainage pockets may include zippered, or mesh pockets integrated into side or rear panels with drainage holes to reduce drag and water retention.

In alternate embodiments, hidden drainage mesh pocket may comprise two side pockets with mesh lining and grommet or laser-cut drainage holes. Rear utility pocket may be implemented with fold-over or zipper flap with drainage slits, measuring approx. 5"×6".

Branding Area

In an embodiment, the branding area may include logo placement at lower left leg and on interior liner. The outer logo area may include a 2.5"×2.5" Spartan helmet with "SPARTA" text. The inner lining logo size may include 1.5" wide at hem level.

Dimensions and Fit

In some embodiments, the dimension and fit may include:

Size M (standard men's sizing):

Waist (flat): 16-17"

Inseam: 7"

Outer short length: 17"

Liner inseam: 8.5"

Leg opening: 11"

Liner leg opening: 8.75"

(Fit is designed to be athletic/slim with stretch allowance in gusset and waistband.)

Flatlock and Bonded Seams

In still another embodiment, flatlock and bonded seams may allow for reduced chafing and seam friction in wet conditions while improving seam strength and reducing drag.

Laser-Cut Eyelets and Logo Venting

In an embodiment, laser-cut eyelets and logo venting may allow for integrated airflow via laser-perforated side logos or design accents that function as water egress points. In other embodiments, laser-cut logo vents may be on the outer leg panels measuring approx. 1.5"×2" and airflow channels integrated into side seams using perforated panels.

In some embodiments, the present invention has the following advantages:

- Combines the dynamic movement of MMA shorts with hydrodynamic design and rapid-dry materials of surf shorts.
- Enhanced performance for aquatic action sports like surfing, jet skiing, kiteboarding, and wake surfing.
- Eliminates the limitations of traditional board shorts (no gusset, low stretch, weak closures) and non-waterproof MMA shorts (heavy when wet, lack drainage, slow drying).

In other embodiments, the present invention present invention has the following advantages:

- Incorporates full MMA-range mobility while maintaining water functionality.
- Eliminates need for underlayers—reduces drag and improves comfort.
- Secure, fail-proof waistband keeps shorts in place during wipeouts or dynamic maneuvers.
- Fast-drying and breathable—reduces bacterial growth and odor common in other hybrid shorts.

In an embodiment, the present invention may be a reversible design for aesthetic and functional versatility; include a compression liner insert for anti-chafing underlay; and allow for integration with RFID locker tags or waterproof pouch slot.

In yet another embodiment, the present invention may have reversible color schemes with an outer shell with two-color panels and reversible liner; modular attachments with a RFID locker key slot integrated into waistband or small waterproof pouch; and eco versions that are 100% recycled ocean plastic fabric for a sustainable surf wear line.

In another embodiment, the present invention may include a pair of board shorts for use in water-based sports, comprising: a multi-panel short body constructed from a hydrophobic, quick-drying fabric configured to cover at least a portion of a wearer's waist, hips, and thighs; a stretch gusset panel positioned at a crotch region of the short body and composed of a four-way stretch material to provide increased range of motion; a pair of side leg slits located at the lower lateral edges of each leg of the short body, the leg slits facilitating lateral leg mobility during athletic activity; a closure system at a front waistband portion of the short body comprising at least a hook-and-loop fastener and a drawstring assembly configured to securely fasten the shorts to the wearer; at least one pocket integrated into the short body, the pocket having drainage apertures adapted to allow water to exit during use in aquatic environments; wherein the multi-panel short body and gusset panel collectively allow enhanced mobility, secure fit, and rapid drying during high-movement water-based athletic activities.

In yet another embodiment, the present invention may include one or more: wherein the stretch gusset panel is trapezoidal or diamond-shaped and extends across the inner thigh region; wherein the hydrophobic fabric includes a durable water-repellent (DWR) coating applied to a polyester-spandex blend; wherein the side leg slits are reinforced with bonded tape seams or double-stitched hems to enhance durability in aquatic conditions; wherein the waistband further comprises an elastic rear portion and/or silicone gripper lining to resist slippage during athletic motion; wherein the hook-and-loop fastener is further secured with a clasp buckle or compression tab for additional waistband security; wherein the pocket includes mesh lining and is positioned at a side or rear panel location of the short body; a flatlock or bonded seam construction throughout the short body to reduce chafing and increase hydrodynamic efficiency; laser-perforated vent holes or integrated mesh panels for enhanced breathability and water drainage.

It should also be understood that, unless a term is expressly defined in this patent using the sentence, there is no intent to limit the meaning of that term, either expressly or by implication, beyond its plain or ordinary meaning, and such term should not be interpreted to be limited in scope based on any statement made in any section of this patent application (other than the language of the claims). To the extent that any term recited in the claims at the end of this patent application is referred to in this patent application in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Many different arrangements of the various components depicted, as well as components not shown, are possible without departing from the spirit and scope of the present invention. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A pair of hybrid athletic shorts configured for aquatic and high-mobility sports activities comprising: an exterior shell having a multi-panel construction formed from a hydrophobic, quick-dry, stretchable fabric; an interior compression liner integrally attached to a waistband of the exterior shell, the liner composed of a moisture-wicking, four-way stretch fabric; a gusset panel disposed in a crotch region of the exterior shell, the gusset panel having a generally polygonal shape selected from diamond and trapezoidal configurations, the gusset comprising a stretchable material to facilitate leg separation and mobility; a side slit disposed on each leg of the exterior shell, extending upward from a bottom hem to enhance range of motion; a waistband assembly comprising a drawstring, an internal closure mechanism, and a hook-and-loop fastener for securing the waistband to the wearer's body; one or more drainage pockets having mesh linings and fluid-ejection apertures for reducing water retention during aquatic use; and at least one laser-perforated vent or logo opening disposed on a side panel of the exterior shell to facilitate drainage and ventilation, wherein the internal closure mechanism is operatively coupled to the drawstring routed circumferentially within the waistband assembly and a cooperating fastening structure positioned internally of the waistband assembly and wherein the gusset panel, liner, and exterior shell are secured together at a common seam interface by flatlock or bonded stitching, forming a continuous load path across the crotch region during leg separation.

2. The hybrid athletic shorts of claim 1, wherein the multi-panel construction comprises at least two front leg panels, two rear leg panels, and a waistband panel tailored to match human anatomical contours.

3. The hybrid athletic shorts of claim 1, wherein the gusset panel is diamond-shaped and measures between 7.0-8.0 inches in length and between 4.0-5.0 inches in width.

4. The hybrid athletic shorts of claim 1, wherein the compression liner extends beyond the outer hem of the exterior shell by at least 1 inch and includes a silicone gripper band at the liner hem to prevent ride-up.

5. The hybrid athletic shorts of claim 1, wherein the waistband includes a 2.5-inch high waistband panel with a rear elastic segment and interior silicone gripper strip.

6. The hybrid athletic shorts of claim 1, wherein the fly flap extends upward from a front panel into the waistband assembly and overlies an opening through which the drawstring exits the waistband assembly, thereby concealing the drawstring and internal closure mechanism.

7. The hybrid athletic shorts of claim 1, further comprising a rear utility pocket with a fold-over flap and grommet or laser-drilled holes to allow water egress.

8. Athletic apparel configured for aquatic and high-mobility sports activities, comprising: an exterior shell having a multi-panel construction formed from a hydrophobic, quick-dry, stretchable fabric; an interior compression liner integrally attached to a waistband of the exterior shell, the liner composed of a moisture-wicking, four-way stretch fabric; a gusset panel disposed in a crotch region of the exterior shell, the gusset panel having a generally polygonal shape selected from diamond and trapezoidal configurations, the gusset comprising a stretchable material to facilitate leg separation and mobility; a side slit disposed on each leg of the exterior shell, extending upward from a bottom hem to enhance range of motion; a waistband assembly comprising a drawstring, an internal closure mechanism, and a hook-and-loop fastener for securing the waistband to the wearer's body; one or more drainage pockets having mesh linings and fluid-ejection apertures for reducing water retention during aquatic use; and at least one laser-perforated vent or logo opening disposed on a side panel of the exterior shell to facilitate drainage and ventilation wherein the internal closure mechanism is operatively coupled to the drawstring routed circumferentially within the waistband assembly and a cooperating fastening structure positioned internally of the waistband assembly and wherein the gusset panel, liner, and exterior shell are secured together at a common seam interface by flatlock or bonded stitching, forming a continuous load path across the crotch region during leg separation.

9. The athletic apparel of claim 8, wherein the exterior fabric comprises a polyester-spandex blend with a durable water-repellent (DWR) coating and a weight between 170-180 grams per square meter.

10. The athletic apparel of claim 8, wherein the laser-perforated vents form a logo and are dimensioned 1.5 inches by 2 inches.

11. The athletic apparel of claim 8, further comprising bonded seams or flatlock stitching along panel intersections to reduce drag and prevent chafing in wet conditions.

12. The athletic apparel of claim 8, wherein the shorts further comprise an RFID tag pocket or waterproof compartment integrated into the waistband.

13. The athletic apparel of claim 8, wherein the multi-panel construction comprises at least two front leg panels, two rear leg panels, and a waistband panel tailored to match human anatomical contours.

14. The athletic apparel of claim 8, wherein the gusset panel is diamond-shaped and measures between 7.0-8.0 inches in length and between 4.0-5.0 inches in width.

15. A pair of board shorts configured for aquatic and high-mobility sports activities, comprising: an exterior shell having a multi-panel construction formed from a hydrophobic, quick-dry, stretchable fabric; an interior compression liner integrally attached to a waistband of the exterior shell, the liner composed of a moisture-wicking, four-way stretch fabric a gusset panel disposed in a crotch region of the exterior shell, the gusset panel having a generally polygonal shape selected from diamond and trapezoidal configurations, the gusset comprising a stretchable material to facilitate leg separation and mobility; a side slit disposed on each leg of the exterior shell, extending upward from a bottom hem to enhance range of motion; a waistband assembly comprising a drawstring, an internal closure mechanism, and a hook-and-loop fastener for securing the waistband to the wearer's body; one or more drainage pockets having mesh linings and fluid-ejection apertures for reducing water retention during aquatic use; and at least one laser-perforated vent or logo opening disposed on a side panel of the exterior shell to facilitate drainage and ventilation, wherein the internal closure mechanism is operatively coupled to the drawstring routed circumferentially within the waistband assembly and a cooperating fastening structure positioned internally of the waistband assembly and wherein the gusset panel, liner, and exterior shell are secured together at a common seam interface by flatlock or bonded stitching, forming a continuous load path across the crotch region during leg separation.

16. The board shorts of claim 15, wherein the multi-panel construction comprises at least two front leg panels, two rear leg panels, and a waistband panel tailored to match human anatomical contours.

17. The board shorts of claim 15, wherein the gusset panel is diamond-shaped and measures between 7.0-8.0 inches in length and between 4.0-5.0 inches in width.

18. The board shorts of claim 15, wherein the compression liner extends beyond the outer hem of the exterior shell by at least 1 inch and includes a silicone gripper band at the liner hem to prevent ride-up.

19. The board shorts of claim 15, wherein the waistband includes a 2.5-inch high waistband panel with a rear elastic segment and interior silicone gripper strip.

20. The board shorts of claim 15, wherein the fly flap extends upward from a front panel into the waistband assembly and overlies an opening through which the drawstring exits the waistband assembly, thereby concealing the drawstring and internal closure mechanism.

* * * * *